US009135863B2

(12) United States Patent
Duerksen et al.

(10) Patent No.: US 9,135,863 B2
(45) Date of Patent: Sep. 15, 2015

(54) DISTORTION-CORRECTING DEFORMABLE DISPLAYS

(75) Inventors: Gary Lynn Duerksen, Ward, CO (US); Seth Adrian Miller, Englewood, CO (US)

(73) Assignee: EMPIRE TECHNOLOGY DEVELOPMENT LLC, Wilmington, DE (US)

( * ) Notice: Subject to any disclaimer, the term of this patent is extended or adjusted under 35 U.S.C. 154(b) by 111 days.

(21) Appl. No.: 13/811,220

(22) PCT Filed: Apr. 23, 2012

(86) PCT No.: PCT/US2012/034709

§ 371 (c)(1), (2), (4) Date: Jan. 18, 2013

(87) PCT Pub. No.: WO2013/162509

PCT Pub. Date: Oct. 31, 2013

(65) Prior Publication Data

US 2013/0278486 A1 Oct. 24, 2013

(51) Int. Cl.
*G09G 3/20* (2006.01)
*G09G 3/34* (2006.01)

(52) U.S. Cl.
CPC .. *G09G 3/34* (2013.01); *G09G 3/20* (2013.01); *G09G 2320/0693* (2013.01); *G09G 2340/0464* (2013.01); *G09G 2380/02* (2013.01)

(58) Field of Classification Search
CPC ..... G09G 3/34; G09G 2380/02; G09G 2320/0693; G09G 3/20; G09G 2340/0464; G09G 2300/0842; G09G 3/3688
USPC ..... 345/55
See application file for complete search history.

(56) References Cited

U.S. PATENT DOCUMENTS

| | | | | |
|---|---|---|---|---|
| 4,442,717 | A * | 4/1984 | Kurtz et al. | 73/766 |
| 5,541,372 | A | 7/1996 | Baller et al. | |
| 6,259,425 | B1 * | 7/2001 | Shimizu | 345/94 |
| 7,470,569 | B2 | 12/2008 | Cok | |
| 8,466,873 | B2 * | 6/2013 | Vertegaal et al. | 345/156 |
| 8,510,056 | B2 * | 8/2013 | Atashbar et al. | 702/19 |
| 2008/0036883 | A1 * | 2/2008 | Hara | 348/246 |
| 2010/0245246 | A1 * | 9/2010 | Rosenfeld et al. | 345/163 |
| 2010/0291711 | A1 | 11/2010 | Atashbar et al. | |
| 2012/0092363 | A1 * | 4/2012 | Kim et al. | 345/618 |

FOREIGN PATENT DOCUMENTS

| | | | |
|---|---|---|---|
| CN | 101127840 | A | 2/2008 |
| CN | 102378955 | A | 3/2012 |

(Continued)

OTHER PUBLICATIONS

Briggs, "Machine Contoring Using Minimum Curvatore," Geophysics, 1974, vol. 19(2).

(Continued)

*Primary Examiner* — Towfiq Elahi
(74) *Attorney, Agent, or Firm* — Knobbe, Martens, Olson & Bear, LLP

(57) ABSTRACT

Provided herein are devices and methods relating to detecting and/or correcting distortions and other events that can occur to a display surface so that a desired image is viewed despite the presence of a distortion in the display surface itself.

23 Claims, 6 Drawing Sheets

(56) References Cited

FOREIGN PATENT DOCUMENTS

| | | |
|---|---|---|
| WO | WO 2011/041507 | 4/2011 |
| WO | WO2011/118315 A1 | 9/2011 |

OTHER PUBLICATIONS

Dot Pitch (from Wikipedia), http://en.wikipedia.org/wiki/Dot_pitch; information was available at website: http://en.wikipedia.org/wiki/Dot_pitch in some form no later than Nov. 4, 2011. While a website as it existed on Nov. 4, 2011, is not in Applicant's possession, Applicant has provided the website that was printed on Aug. 1, 2012.

File: Vector Video Standarts2.svg (from Wikipedia); http://en.wikipedia.org/wiki/File:Vector_Video_Standarts2.svg; information was available at website: http://en.wikipedia.org/wiki/File:Vector_Video_Standarts2.svg in some form no later than Nov. 4, 2011. While the website as it existed on Nov. 4, 2011, is not in Applicant's possession, Applicant has provided the website that was printed on Jan. 4, 2012.

International Search Report and Written Opinion received in International Application No. PCT/US2012/034709, dated Jul. 20, 2012, filed on Apr. 23, 2012.

Lillemose, "Piezoresistive Polymer Composites for Cantilever Readout," Department of Micro and Nanotechnology, Technical University of Denmark, Lyngby, Denmark, May 31, 2008, 128 pages.

Liu et al., "Patterning Conductive PDMS Nanocomposite in an Elastomer Using Microcontact Printing," J. Micromech. Microeng., 2009, vol. 19.

Lucci et al., "Carbon Nanotubes Films for Sensing Applications: From Piezoresistive Sensor to Gas Sensing," Springer Proceedings in Physics, 2006, pp. 191-194, vol. 110.

Rogers et al., "Materials and Mechanics for Stretchable Electronics," Science, Mar. 26, 2010, pp. 1603-1607, vol. 327.

Takulapalli et al., A Nanocontact Printing System for Sub-100 nm Aligned Patterning, Nanotechnology, 2011, 22 285302.

* cited by examiner

DISTORTION-CORRECTING DEFORMABLE DISPLAYS

CROSS-REFERENCE TO RELATED APPLICATIONS

This application is the U.S. National Phase entry under 35 U.S.C. §371 of International Application No. PCT/US2012/034709, filed Apr. 23, 2012, the contents of which are hereby incorporated by reference in its entirety.

TECHNICAL FIELD

Embodiments herein generally relate to deformable display surfaces and methods of use relating to compensating or adjusting for deformations in the display surface.

BACKGROUND

Significant advances have been made over the past decade in flexible and stretchable systems for user interfaces and/or displays. There is growing interest in deformable display. Such displays can allow for the integration of the display over a wide range of surface conformations.

SUMMARY

In some embodiments, a self-correcting deformable display is provided. In some embodiments, this can include a deformable display including at least a first pixel and a second pixel, a processor in communication with the deformable display, and at least one strain sensor incorporated into the deformable display. In some embodiments, the strain sensor is in communication with the processor. In some embodiments, the processor is in communication with the deformable display.

In some embodiments, a self-correcting deformable display is provided. In some embodiments, the display includes a display substrate, an array of strain sensors associated with the display substrate, and a processor configured to generate a distortion map from the array of strain sensors. In some embodiments, the distortion map includes a collection of strain values from the array of strain sensors. In some embodiments, the distortion map represents the distortion of an original desired image given a distortion to the display substrate. In some embodiments, the display device further includes a distortion compensation filter. In some embodiments, the filter is configured to use the distortion map to adjust the original desired image to a compensated image that can be displayed on the display substrate. In some embodiments, the compensated image compensates for the distortion to produce an appearance of a compensated desired image when the display substrate is distorted. In some embodiments, the filter can be stored on a computer readable medium and the filter can be applied by a computer so as to update the image on the display.

In some embodiments, a method of providing a self-correcting image is provided. In some embodiments, the method includes providing a deformable display, distorting the display to provide a distorted deformable display, measuring at least one amount of distortion of the display resulting from distorting the display to create a distortion map, providing an original image, using the distortion map to adjust the original image to create a compensated image, and displaying the compensated image on the distorted deformable display. In some embodiments, the compensated image has an appearance that is similar to the original image when displayed on the distorted deformable display.

In some embodiments, a method of calibrating a pixel intensity is provided, in some embodiments, the method includes providing a flexible display surface including an array of pixels. In some embodiments, the display surface includes at least a first axis of the display, a second axis of the display, and a center of the display. In some embodiments, the method further includes determining a global scale factor of the first axis and the second axis, determining the center of the display, and determining a displacement of at least one pixel from a first position to a second position. In some embodiments, the first position is where the pixel is when the flexible display surface is at rest, and the second position is where the pixel is when the flexible display surface is deformed, in some embodiments, the method further includes calibrating the pixel intensity to compensate for the displacement.

In some embodiments, a viewing surface including the display of any one of the embodiments provided herein is provided. In some embodiments, the viewing surface is part of at least one of the following: a contact lens, a rigid curved surface, a flexible surface, a display panel on an automobile.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

FIG. 1A is a drawing depicting some embodiments of a resulting image following distortion.

FIG. 1B is a drawing depicting some embodiments of a compensated image.

FIG. 1C is a drawing depicting some embodiments of a compensated image.

DETAILED DESCRIPTION

Figure 1C:
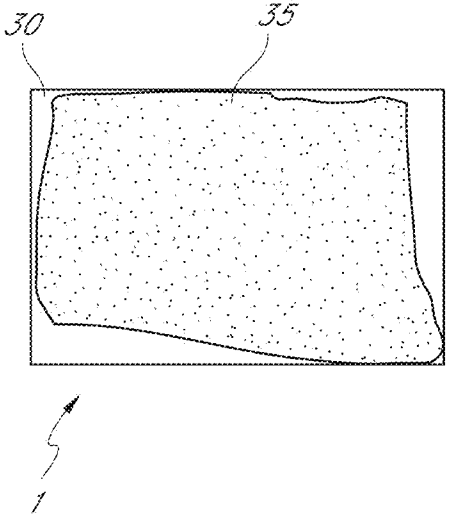
FIGS. 1A-1C are drawings depicting some embodiments of distorted displays.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

Provided herein are methods and devices relating to modifying the appearance of a displayed image on a display. In some embodiments, this modification can be employed when the display itself has been distorted and/or deformed in some manner. In some embodiments, the display can be flexible and/or deformable. In some embodiments, when the display is flexed or deformed from its normal position, the displayed image can be adjusted (optionally in real time) so that the image itself appears "normal" and/or "less distorted" than it would if simply provided on the physically distorted display.

Figure 1B:
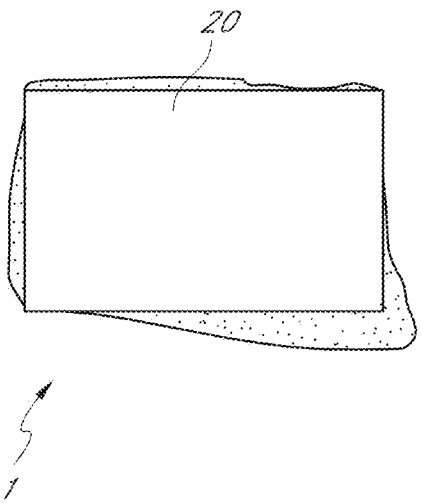
Figure 1A:
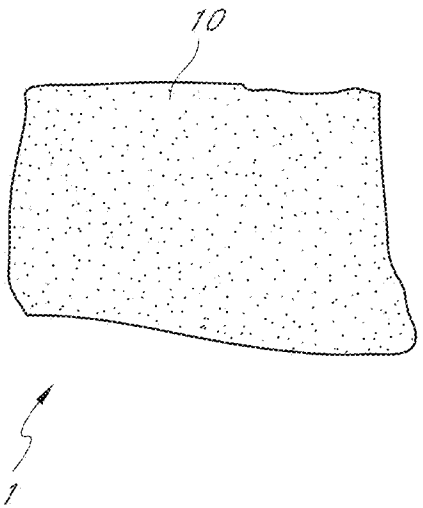

As shown in FIG. 1A, when a flexible display 1 is distorted, the image 10 on the display is also, traditionally, distorted. However, some of the embodiments provided herein allow for the correction and/or reduction of the visual distortion of the image on the display. In some embodiments, the image 20 can be resized on the display 1 (FIG. 1B), so as to provide an undistorted image (at least closer to normal than the distorted image in FIG. 1A). In some embodiments, the image 30 can keep its size relative to the display 1, but the actual image displayed 35 can be a part of the full image, but be an undistorted section of that image (FIG. 1B), so as to provide an undistorted image (at least closer to normal than the distorted image in FIG. 1A). Other options for compensating and/or reducing distortion effects on a display device are provided below.

Figure 2:
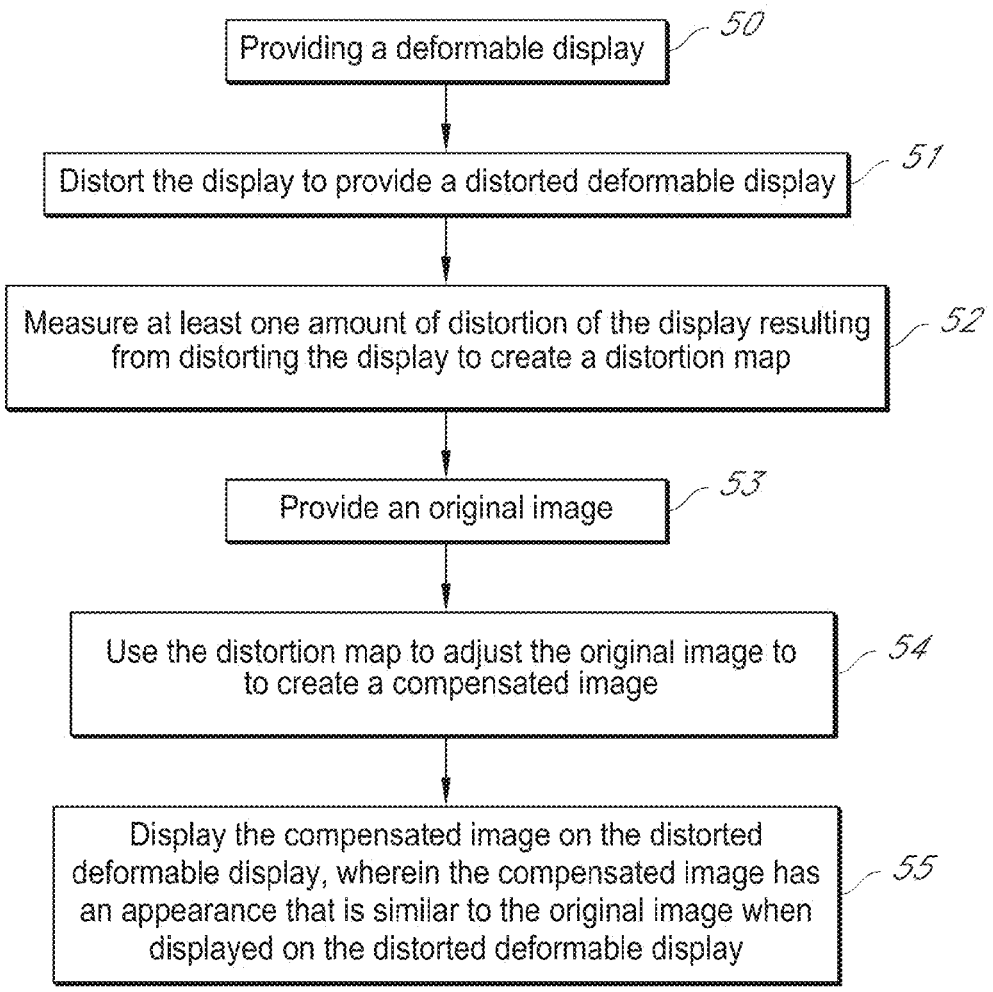
FIG. 2 is a flow chart depicting some embodiments of adjusting an image.

While these (and other) modifications can be achieved in a variety of ways, some such embodiments are outlined in the flow chart in FIG. 2. In some embodiments, one can start by providing a deformable display (block 50). In some embodiments, one can then distort the display to provide a distorted deformable display (block 51). In some embodiments, one can then measure at least some amount of distortion in the display resulting from the distortion of the displayed image to create a distortion map (block 52). One can then provide an original image and use the distortion map to adjust the original image to create a compensated image (block 53). One can then display the compensated image on the distorted deformable display (block 54). Because the compensated image will adjust for the change in location or other aspect of the pixels, the compensated image will have an appearance that is similar to the original image when displayed on the distorted deformable display.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

Figure 3:
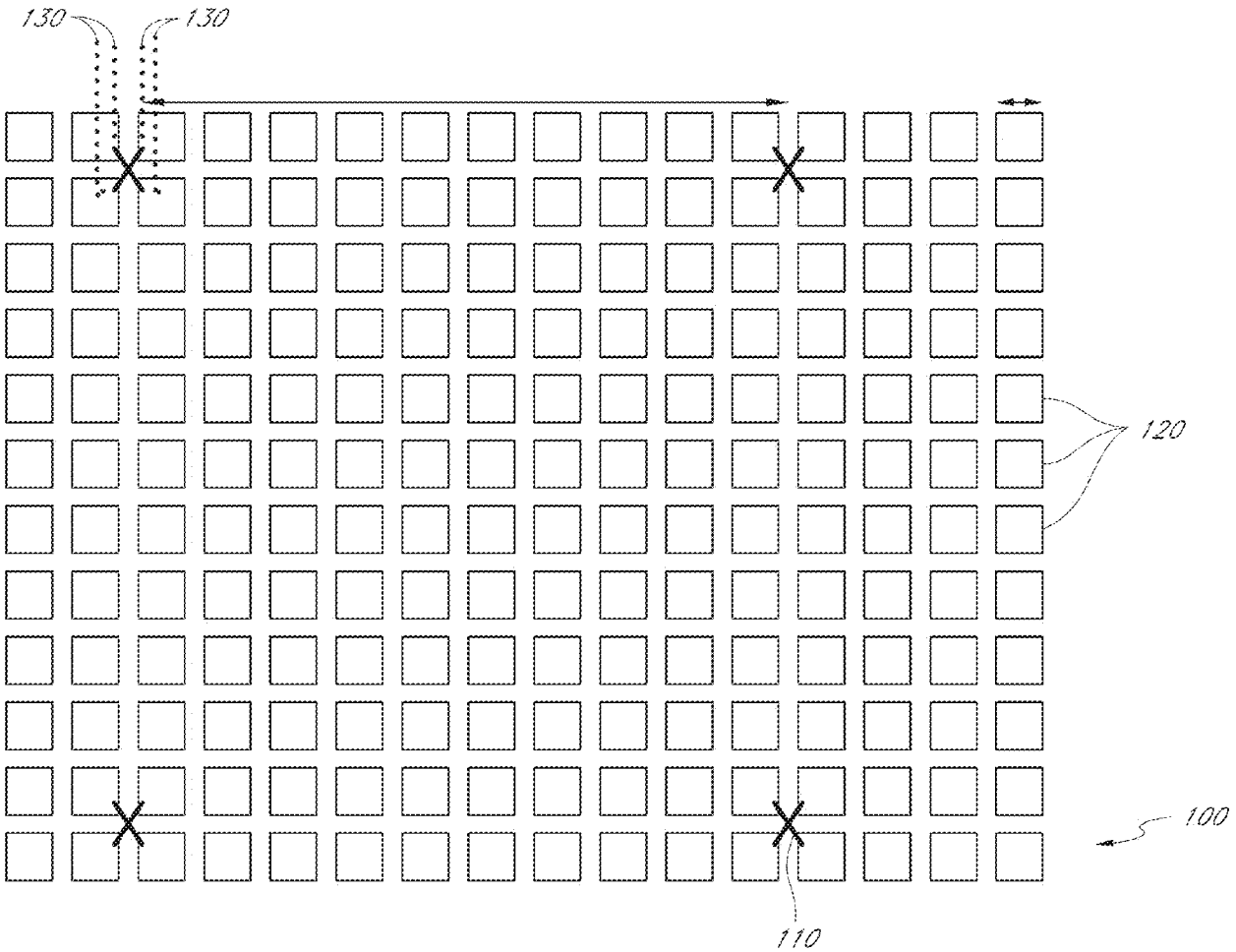
FIG. 3 is a drawing depicting some embodiments of arrangements of stretch sensors provided herein.

While the above method will be discussed in more detail below, it is noted that there are a variety of devices that can be employed to perform the above method and/or other display compensating processes and/or methods. FIG. 3 provides a general description for some embodiments of such a compensating display device. In some embodiments, the display device 100 can include a number of pixels 120 arranged in a desired manner. In some embodiments, one or more strain sensors 110 can be present in or associated with the display, such that a deformation in the display can be detected by the one or more strain sensors. In some embodiments, the strain sensors 110 can be in electrical communication with a processor, and/or computer, and/or a device or system storing and/or processing data for the image to be displayed on the pixels, by leads 130, such that changes in the sensors are communicated to a computer or other processor containing device and the information can be used to alter the image output on the pixels.

In some embodiments, the device in FIG. 3 can be a self-correcting deformable display. In some embodiments, the deformable display can include at least a first pixel and a second pixel, a processor in communication with the deformable display, and at least one strain sensor incorporated into the deformable display. In some embodiments, the strain sensor is in communication with the processor. In some embodiments, the processor is in communication with the deformable display. In some embodiments, the strain sensor is configured to detect a distortion between the first pixel and the second pixel and to provide a datum regarding the distortion.

In some embodiments, the deformable display includes and/or is made of an elastomer substrate. In some embodiments, the elastomer can be any one or more of the following: unsaturated rubber, natural polyisoprene polyisoprene natural rubber (NR) and trans-1,4-polyisoprene gutta-percha), synthetic polyisoprene (Isoprene Rubber), Polybutadiene (Butadiene Rubber), Chloroprene rubber (CR), polychloroprene, Neoprene, Baypren, Butyl rubber (copolymer of isobutylene and isoprene, IIR), halogenated butyl rubbers (chloro butyl rubber, bronco butyl rubber), styrene-butadiene rubber (copolymer of styrene and butadiene), nitrile rubber (copolymer of butadiene and acrylonitrile, NBR), hydrogenated nitrile rubbers (HNBR) therban and zetpol, saturated rubbers, EPM (ethylene propylene rubber) and EPDM rubber (ethylene propylene diene rubber), epichlorohydrin rubber (ECO), polyacrylic rubber (ACM, ABR), silicone rubber (SI, Q, VMQ), fluorosilicone rubber (FVMQ), fluoroelastomers (FKM, and FEPM) viton, tecnoflon, fluorel, atlas and daiel, perfluoroelastomers (FFKM), tecnoflon PFR, kalrez, chemraz, perlast, polyether block amides (PEBA), chlorosulfonated polyethylene (CSM), (Hypalon), ethylene-vinyl acetate (EVA), Thermoplastic elastomers (TPE), and/or polysulfide rubber.

In some embodiments, the first pixel and the second pixel are part of an array of pixels. In some embodiments, the array is an ordered array. In some embodiments, the array is part of a viewable surface. In some embodiments, the array includes two or more pixels, e.g., 2, 10, 100, 1000, 10,000, 100,000, 1,000,000, or 10,000,000 or more pixels, including any range above any one of the preceding values and any range between any two of the preceding values. In some embodiments, any of the above ranges can be a pixel density on a per square inch basis. In some embodiments, the display can be a 320×240, 320×200, 640×480, 768×576, 800×600, 1024×768, 1280×854, 1280×960, 1280×1024, 1400×1050, 1600×1200, 2048×1536, 2560×2048, 2560×1600, 1920×1200, 2048×1080, 1920×1080, 1680×1050, 1440×960, 1440×900, 1280×800, 1366×768, 1280×768, 1280×720, 1152×768, 1024×600, 854×480 or 800×480 display.

In some embodiments, the pixels of the array can all be of a same type of pixel type. In some embodiments, one or more of the pixels can be different. In some embodiments, the first pixel includes a first light emitting diode and the second pixel includes a second light emitting diode.

In some embodiments, the display device includes one or more strain sensors. In some embodiments, the device includes 2, 3, 4, 5, 6, 7, 8, 9, 10, 50, 100, 1000, 10,000, 100,000, 1,000,000, or 10,000,000 strain sensors, including any range above any one of the preceding values and any range between any two of the preceding values.

In some embodiments, the first pixel and the second pixel are spaced apart no more than about 10,000 microns, e.g., 10,000, 5,000, 1,000, 900, 800, 700, 600, 500, 400, 300, 250, 200, 150, 100, 50, 25, or 10 microns apart, including any range below any one of the preceding values or any range between any two of the preceding values.

In some embodiments, the strain sensors are evenly distributed throughout the display. In some embodiments, the strain sensors are unevenly distributed throughout the display. In some embodiments, a greater density of strain sensors is present in an area of the display where greater detail in the appearance of the image is desired. In some embodiments, a greater density of strain sensors is present in an area of the display where a greater distortion is likely to occur (e.g., from and/or during use of the display). In some embodiments, a greater density of strain sensors is present in an area of the display where the display itself is more flexible. In some embodiments, these areas can contain 1, 5, 10, 20, 30, 40, 50, 60, 70, 80, 90, 95, 98, 99, or 100% of the strain sensors in the display.

In some embodiments, the maximum strain is about 30% or greater. In some embodiments, the display is stretchable to at least 1% more than its resting state, e.g., 1, 3, 4, 5, 6, 7, 8, 9, 10, 15, 20, 25, 30, or about 35% including any range above any one of the preceding, values. In some embodiments, where the light-emitting elements are capable of further stretching (or are not limiting), greater values are achievable (for example, 100% or more of its resting state).

In some embodiments, a distance between the first strain sensor and the second strain sensor is no more than about $W_{max}$, where $W_{max}$=((distance between the first pixel and the second pixel)*π)/2*(maximum strain). In some embodiments, the spacing between the first strain sensor and the second strain sensor is no more than about 2.6 mm. In some embodiments, the spacing is determined upon the need for detection of distortions in the display and/or the need to adjust the image in light of distortions. In some embodiments, the spacing of the strain sensors corresponds to a spacing of the pixels, for example, as frequently as the pixels, every other pixel, every fifth pixels, every tenth pixel, every fiftieth pixel, or every one-hundredth pixel, including any range greater than any one of the preceding values or any range between any two of the preceding values. In some embodiments, the strain sensors are positioned every 1, 10, 100, 500, 1,000, 1,500, 2,000, 2,500, 3,000, 4,000, 5,000, 6,000, 7,000, 8,000, 9,000, 10,000, 100,000, or 1,000,000 microns. In some embodiments, the positioning distance can be the same in both the x and the y axis. In some embodiments, the frequency of positioning can be different in the x and the y axis.

In some embodiments, the density of strain sensors is about 10% of the density of pixels in the deformable display. In some embodiments, the density of strain sensors is equal to or less than about 10% of the density of pixels in the deformable display, e.g., 9, 5, 1% of the density of the pixels in the deformable display, including any range beneath any one of the preceding values and any range between any two of the preceding values. In some embodiments, the density of strain sensors is equal or greater than about 10% of the density of pixels in the deformable display, e.g., 10, 20, 30, 40, 50, 60, 70, 80, 90, 100, 150, or 200% of the density of the pixels in the deformable display, including any range above any one of the preceding values and any range between any two of the preceding values.

In some embodiments, the one or more strain sensor can be used on a deformable display. In some embodiments, a self-correcting deformable display is provided. In some embodiments, it can include a display substrate, an array of strain sensors associated with the display substrate, and a processor configured to generate a distortion map from the array of strain sensors. In some embodiments, the distortion map includes a collection of strain values from the array of strain sensors, and the distortion map represents the distortion of an original desired image given a distortion to the display substrate. In some embodiments, the deformable display further includes a distortion compensation filter. In some embodiments, the filter is configured to use the distortion map to adjust the original desired image to a compensated image that can be displayed on the distorted display substrate. In some embodiments, the compensated image compensates for the distortion to produce an appearance of a compensated desired image when the display substrate is distorted. In some embodiments, the distortion map is stored on a computer readable media. In some embodiments, any one or more of the processes provided herein can be executed by a computer or other processing device. In some embodiments, the processor for the initial image and the application of the filter can be one in the same device. In some embodiments, they can be different devices.

In some embodiments, the compensated desired image and the original desired image are the same image. In some embodiments, the appearance of the original desired image and the appearance of the compensated desired image are substantially the same image. In some embodiments, the appearance of the original desired image and the appearance of the compensated desired image are more similar than the appearance of the stretched and/or distorted original image and appearance of the unstretched original image. In some embodiments, while there are differences between the appearance of the original desired image and the appearance of the compensated desired image, they are less distracting and/or noticeable than if the original image had been viewed without the correction on the distorted display. In some embodiments, the differences are in the amount and/or size of the image of the compensated desired image. For example, as shown in FIGS. 1B and 1C, in some embodiments, the compensated desired image can be smaller (and thus the image will appear compressed) and/or the compensated desired image can be larger than the full display (and thus some of the original image will be missing, but the remaining image will not appear distorted). In some embodiments, the compensated desired image will appear to be less strained and/or distorted than the appearance of the original image when displayed on the distorted display. In some embodiments, the relative apparent distance between the various pixels will be more consistently maintained throughout the display than would otherwise be achieved (given the distortion of the display).

In some embodiments, the display and/or device can include a processor. In some embodiments, the processor is selected from at least one of a use field-programmable gate array (FPGA) or application specific integrated circuit (ASIC). In some embodiments, the processor is configured to provide an initial image, process information from the at least one strain sensor to transform the initial image into an altered (or compensated) image, and display the altered image on the deformable display. In some embodiment, the processor is configured to perform any one or more of the steps and/or processes provided herein. In some embodiments, the processor is configured to use the datum regarding the distortion to alter an image to be provided on the deformable display, in its deformed configuration. In some embodiments, the processor is in communication with the strain sensor (so it can receive strain related information) and/or in communication with the one or more pixels, so that altered images can be displayed on the pixels, in accordance with the strain and/or flex on the display. In some embodiments, a single processor does both operations. In some embodiments, more than one processor can be used. In some embodiments, there are intervening structures and/or transformations between the processor and the other components, such as a FPGA and/or an ASIC. In some embodiments, the processor is not part of the device. In some embodiments, information is sent from the device and back to the device by a processor that is not physically connected to the display device.

In some embodiments, any method and/or device that can measure a change in a length and/or strain can be employed as a strain sensor. In some embodiments, the strain sensor is integrated onto the display. In some embodiments, the strain sensor is separate from the display but is part of the device (e.g., a separate layer associated with the display, which can be, e.g., above or below the display itself). In some embodiments one or more of the strain sensors can be integrated into the display material (e.g., be within an elastomer layer). In some embodiments, some of the strain sensors are located within, or are part of, the display, and other strain sensors are simply associated with the display and/or monitor distortions in the display in other ways.

In some embodiments, the strain sensor includes at least one of a resistive wire and/or a light guide. In some embodiments, the resistive wire includes at least one of: a carbon nano-tube, a conducting polymer, a graphite-filled polymer, a graphene-filled polymer, or a metal-filled polymer. In some embodiments, the at least one strain sensor is part of an array of strain sensors. In some embodiments, the strain sensor includes polydimethylsiloxane doped with multi-wall carbon nanotubes. In some embodiments, the strain sensor includes an elastomer. In some embodiments, the strain sensor includes an elastomer doped with carbonaceous materials. In some embodiments, the strain sensor includes a metal, such as gold, silver or niobium, for example.

In some embodiments, the strain sensor is capable of measuring a 1% strain or greater, e.g., 1, 2, 3, 4, 5, 10, 15, 20, 25, 30, 35, 40, 45, 50, 60, 70, 80, 90, or 100% strain, including any range greater than any one of the preceding values and any range between any two of the preceding values.

Figure 4:
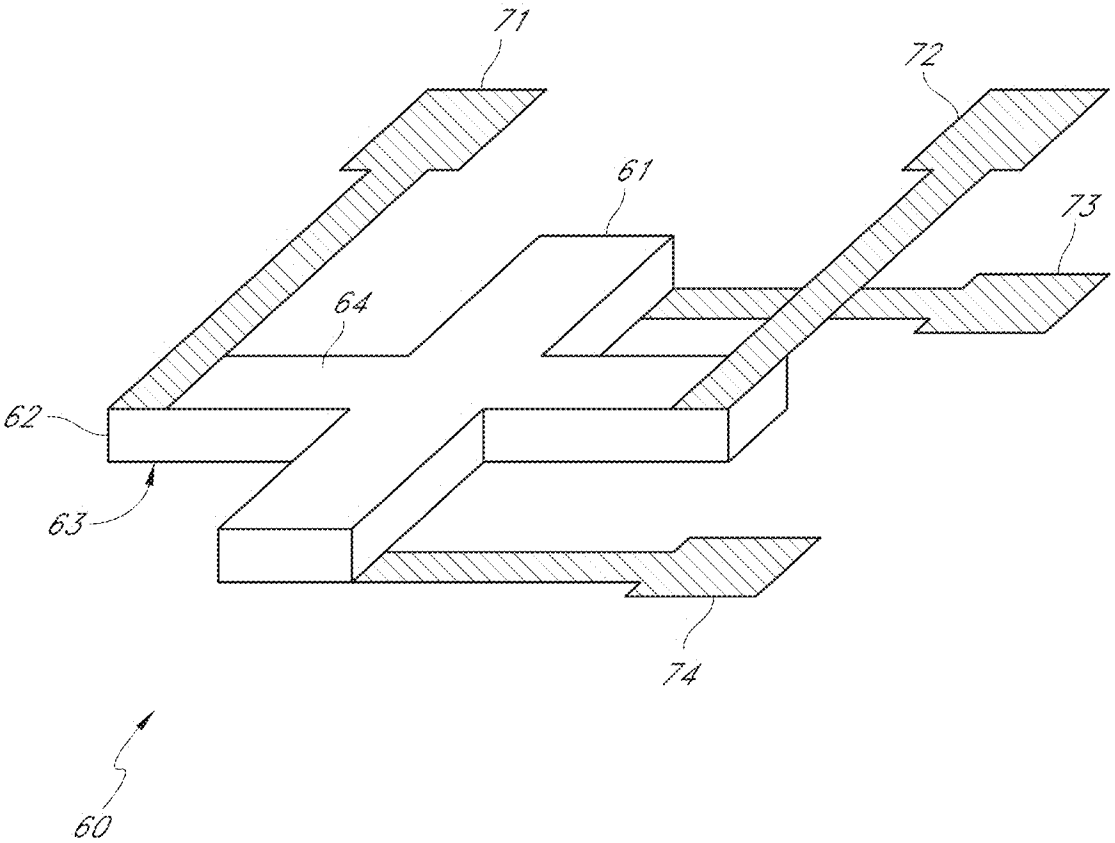
FIG. 4 is a drawing depicting some embodiments of stretch sensors provided herein.

In some embodiments, the strain sensor includes a dual-axis resistivity strain gauge (e.g., as shown in FIG. 4). In some embodiments, the dual-axis resistivity strain gauge 60 includes a first member 61 intersecting a second member 62. In some embodiments, the first member 61 intersects the second member 62 to form a cross shape including a first end, a second end, a third end, and a fourth end. In some embodiments, a first electrical lead and/or resistive wire 71 is connected to the first end, a second electrical lead and/or resistive wire 72 is connected to the second end, a third electrical lead and/or resistive wire 73 is connected to the third end, and a fourth electrical lead and/or resistive wire 74 is connected to the fourth end. In some embodiments a single member is used and a single electrical lead and/or resistive wire. In such embodiments, the strain detected from that single strain sensor can provide information about a single direction of strain and/or stretch. In some embodiments, this is all that is required (e.g., if the display itself can only stretch in one direction and/or is only likely to be stretched in one direction. In some embodiments, information from a first strain sensor, positioned to provide information on a strain applied along the x-axis, can be combined with information from a second strain sensor, which can supply information along another axis. In some embodiments, a first set of resistive wires can run in a first direction, and a second set of resistive wires in a second direction.

As shown in FIG. 4, in some embodiments, two of the resistive wires 72 and 71 can be connected to a top 64 of the second member 62, while the other two 73 and 74 can be connected to a bottom 63 of the first member 61. However, this is merely for convenience and for ease of manufacturing the arrangement shown in FIG. 4. In some embodiments, the sensors can be connected to a same surface.

As will be appreciated by one of skill in the art, the "resolution" (density of strain sensors) in each of the x-axis and/or y-axis can be different for different applications.

In some embodiments, the first electrical lead and/or resistive wire 71 and the first end form about a 90 degree angle, the second electrical lead and/or resistive wire 72 and the second end form about a 90 degree angle, the third electrical lead and/or resistive wire 73 and the third end form about a 90 degree angle, and the fourth electrical lead and/or resistive wire 74 and the fourth end form about a 90 degree angle.

In some embodiments, the first, second, third, and fourth electrical leads and/or resistive wires 71, 72, 73, and 74 include polydimethylsiloxane doped with multi-wall carbon nanotubes.

In some embodiments, the width of the first member is beneath about 500 microns, e.g., 500, 400, 300, 200, 100, 50, 40, 30, 20, or 10 microns, including any range beneath any one of the preceding values and any range between any two of the preceding values. In some embodiments, the thickness of the first member is at least about 0.1 micron, e.g., 0.1, 1, 2, 3, 4, 5, 6, 7, 8, 9, 10, 15, 20, 25, 30, 35, 40, 45, 50, 60, 70, 80, 90, 100 microns, including any range above any one of the preceding values and any range between any two of the preceding values. In some embodiments, the distance from the third electrical lead to the first electrical lead is at least 10 microns, e.g., 10, 50, 100, 150, 200, 250, 300, 350, 400, 450, 500, 600, 700, 800, 900 microns or more, including any range above any one of the preceding values and any range between any two of the preceding values.

In some embodiments, the members can be any thickness and/or width, and/or length. In some embodiments the width of the sensor can be chosen based on the space available. In some embodiments the length can be chosen based on the size of the pixels and the spacing between strain sensors. In some embodiments, the thickness of the strain sensor can determine the resistance of the device. In some embodiments, if the resistance is too low, the sensors draw a lot of power. In some embodiments, if the resistance is too high, it becomes difficult read the value accurately, depending on the input impedance of the measuring electronics. In some embodiments the upper limit of desirable resistance can be around 1 MΩ. Thus, for example, for a sensor 250 μm long by 100 μm wide, a possible thickness would correspond to 1 μm. In some embodiments, the sensor is no thicker than 100 μm when hundreds of these sensors draw tens of milliamps of current for only 1V probe voltage—if one wishes to keep this number in line with the energy consumption of the display itself. In some embodiments, it is possible to use more energy for the sensor than the display. In some embodiments, there are fewer sensors, and thus, these aspects can be adjusted as desired.

Methods

In some embodiments, a method of providing a self-correcting image is provided (e.g., as outlined in FIG. 2). In some embodiments, the method includes providing a deformable display, distorting the display to provide a distorted deformable display, and measuring at least one amount of distortion of the display resulting from distorting the display to create a distortion map. In some embodiments, one can further provide an original image, use the distortion map to adjust the original image to create a compensated image, and display the compensated image on the distorted deformable display. In some embodiments, the compensated image has an appearance that is similar to the original image when the compensated image is displayed on the distorted deformable display. Thus, in some embodiments, one can provide an image that is more similar to an original intended image (e.g., an image that would be displayed on an undistorted display), than would be provided by simply displaying the original image on a distorted display.

In some embodiments, the measuring is achieved by measuring a change in a resistivity. In some embodiments, measurement is done by measuring optical changes. In some embodiments, the measuring is achieved by measuring a change in a capacitance. In some embodiments, this can be achieved via a capacitive strain sensor.

In some embodiments, the deformable display can be any of those provided herein, or other deformable displays. In some embodiments, the deformable display includes an array of pixels, a processor configured to display an image on the display, and at least one strain sensor incorporated into the deformable display. In some embodiments, the strain sensor is in communication with the processor.

In some embodiments, the amount of distortion of the display is determined by measuring a displacement of at least one pixel from a first position to a second position, via one or more stain sensors. In some embodiments, in the first position, the deformable display surface is at rest, and in the second position, the deformable display surface is distorted. In some embodiments, one measures a change in position of a pixel directly. In some embodiments, one measures the change in pixel location indirectly.

In some embodiments, the strain sensors are set up so as to measure general areas of pixels, and thus, provide a general measurement of strain over a larger area (rather than at a pixel by pixel level). In some embodiments, the strain can be measured at a pixel by pixel level. In some embodiments, measuring at least one amount of distortion includes measuring a displacement of at least about 50% of pixels in the array of pixels. In some embodiments, measuring at least one amount of distortion includes measuring a displacement of at least about 5% of pixels in the array of pixels. In some embodiments, measuring at least one amount of distortion includes measuring a displacement of at least about 0.01% of pixels in the array of pixels, e.g., 0.01, 0.1, 0.5, 1, 2, 3, 4, 5, 10, 15, 20, 25, 30, 35, 40, 45, 50, 60, 70, 80, 90, or 100% of the pixels (or a number of positions equal to the percentage of pixels) can be measured. In some embodiments, all of the strain sensors are used in determining a strain and/or displacement of pixels. In some embodiments, only a fraction of the strain sensors are used.

In some embodiments, displaying the compensated image includes dropping pixels from the deformable display so that they do not participate in image creation (see, e.g., FIG. 1B). In some embodiments, displaying the compensated image includes cropping such that only a subpart of the original image is viewable on the distorted deformable display (see, e.g., FIG. 1C).

Figure 5:
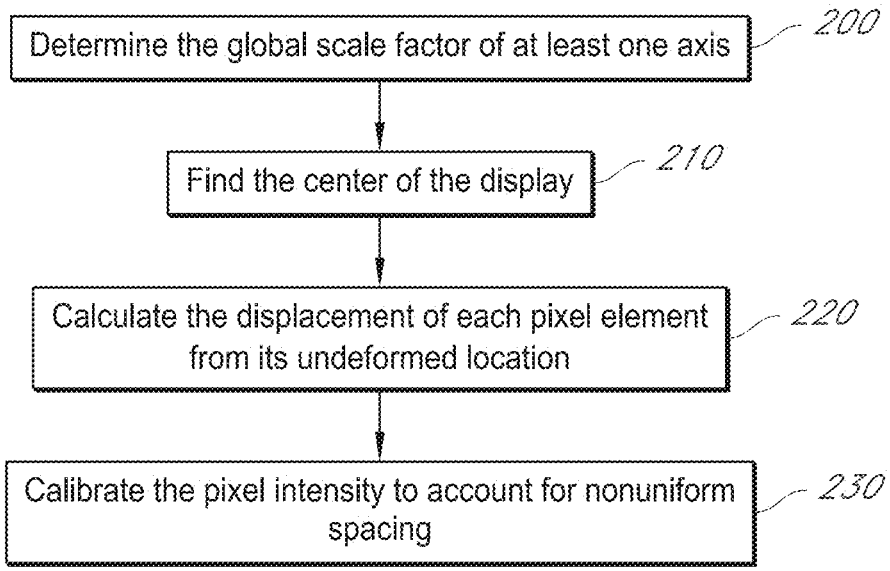
FIG. 5 is a flow chart depicting some embodiments of mapping an image onto a distorted display.
Figure 6:
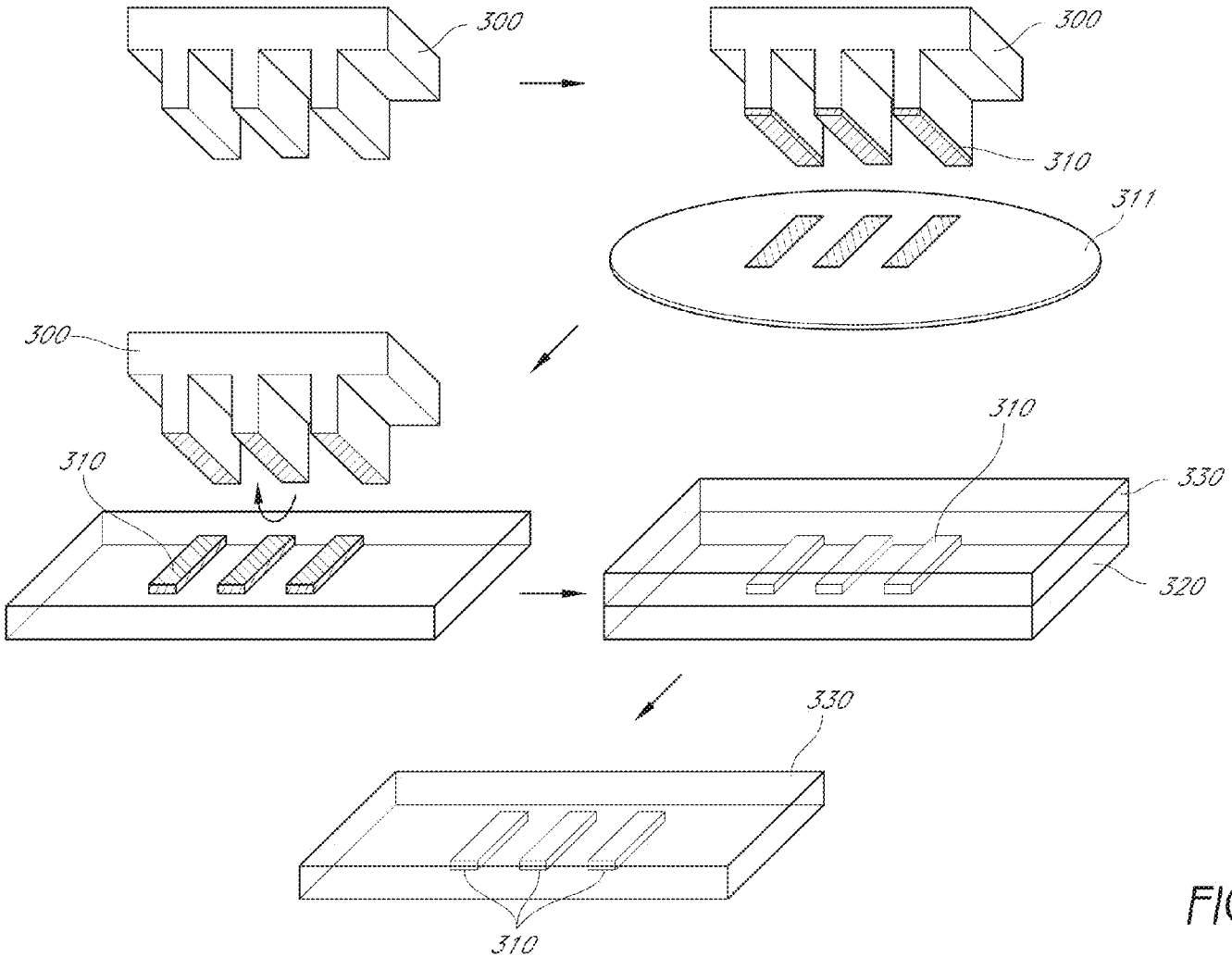
FIG. 6 is a drawing depicting some embodiments for fabricating aspects of stretch sensors.

In some embodiments, part of the compensation, or all of the compensation itself includes a method of calibrating one or more pixel's intensity. An example of such a process is outlined in FIG. 5. In some embodiments, one can optionally provide a flexible display surface that includes an array of pixels. In some embodiments, the display surface includes at least a first axis of the display, a second axis of the display, and a center of the display. As shown in FIG. 5, in some embodiments, one can then determine a global scale factor of the first axis and the second axis (block 200). In some embodiments, one can determine the center of the display (block 210). In some embodiments, one determines a displacement of at least one pixel from a first position to a second position (block 220). In some embodiments, the first position is where the pixel is when the flexible display surface is at rest and the second position is where the pixel is when the flexible display surface is deformed. In some embodiments, one can then calibrate the pixel intensity to compensate for the displacement.

In some embodiments, determining a global scale factor can include converting strain information into dimensional information by either Equation I or II:

$$(\Delta x, \Delta y) = kp \min\left[\min_i\left(\sum_j S_x(j, k)\Big|_i\right), \min_j\left(\sum_i S_y(j, i)\Big|_j\right)\right] \quad \text{Equation I}$$

or $$(\Delta x, \Delta y) = kp \max\left[\max_i\left(\sum_j S_x(j, i)\Big|_i\right), \max_j\left(\sum_i S_y(j, i)\Big|_j\right)\right] \quad \text{Equation II}$$

where k=gauge spacing/pixel spacing, p=pixel spacing, $\Delta x$ is the change along the first axis, and $\Delta y$ is the change in along the second axis, $S_x$ is the strain along the first axis, and $S_y$ is the strain along the second axis.

In some embodiments, the scale change can be determined by either Equation III:

$$= \min\left(\frac{\Delta x}{X}, \frac{\Delta y}{Y}\right) \quad \text{Equation III}$$

or Equation IV:

$$\max\left(\frac{\Delta x}{X}, \frac{\Delta y}{Y}\right) \quad \text{Equation IV}$$

where X and Y are the dimensions along the first axis and the second axis respectively of the undeformed display.

In some embodiments, determining the center of the array can include determining the centroid of the display, when the display is deformed, by Equation V:

$$= (x_0, y_0) = kp\left(\frac{1}{m}\sum_{i,j} S_x(i, j), \frac{1}{n}\sum_{i,j} S_y(i, j)\right) \quad \text{Equation V}$$

In some embodiments, determining a displacement can include using strain as determined by Equation VI:

$$S_{x,y}(kj,ki)=\text{interp2}(j,i,S_{x,y}(j,i),kj,ki,\text{spline}) \quad \text{Equation VI}$$

to develop a distortion map as described in Equation VII:

$$distortionmap = d_{x,y}(ki, kj) = p \sum_{\substack{j=j_0 \\ i=j\cdot k_i/k_j}}^{ki,kj} S_{x,y}(kj, ki) \quad \text{Equation VII}$$

In some embodiments, calibrating the pixel intensity can include determining a relative pixel intensity using Equation VIII:

$$I_{ki,kj}=I_0S_x(kj,ki)S_y(kj,ki) \quad \text{Equation VIII}$$

where $I_{ki,kj}$ is the relative pixel intensity.

In some embodiments, any of the herein disclosed methods and/or devices can be employed as part of or with a viewable display surface. In some embodiments, the viewing surface is part of at least one of the following: a contact lens, a rigid curved surface, a flexible surface, a display panel on an automobile. In some embodiments, the viewing surface can be, or be part of a pop-up element in a planar display and/or an inflatable display. In some embodiments, the display surface is deformed, but is not susceptible to further deformation. In some embodiments, the display surface retains and/or returns to a "normal" or resting shape, but can be distorted and/or deformed during use and/or while being viewed. In some embodiments, the image is compensated in real time, such that deformation of the display need not interfere with viewing. In some embodiments, the compensated image is displayed after the display has stopped changing shape (e.g., once the transition from resting to deformed has stopped), and thus, the final image will only appear when the final deformed state is reached.

In some embodiments, the device and/or methods provided herein further include and/or employ as the processor a mixed signal FPGA. The FPGA can contain an analog-to-digital converter (ADC), which can be suited for reading and digitizing the strain gauge readings. In some embodiments, in which the display is dynamically distorted and is to be compensated in real time, the technology can be an application specific integrated circuit (ASIC), which can serve as a dedicated front-end processing unit for the display driver. In some embodiments, the ASIC can store static (calibration) properties of the strain gauges in ROM, and it can store (re)configuration parameters in Flash memory, if so equipped. In some embodiments, a basic ADC front end and use a graphics processing, unit (GPU) to recompute the output image inclusive of distortion. In some embodiments, this includes additional software programming of the GPU. In some embodiments, one can digitize the distortion readings and dedicate a CPU to converting the readings to a distortion map for input to modify the display driver output. In some embodiments, other processes are applied.

In some embodiments, the number of strain sensors can relate to the resolution in the spatial distortion of the display. If the general form of the distortion is known in advance to be simple, for example, a uniformly curved surface, then one can determine the distortion with relatively few strain sensors (e.g., 5% or less), which in some embodiments, corresponds to 5 mm spatial resolution (for 250 μm pixels). Conversely, if the display is to conform to a surface with complex topography, then in some embodiments, one may wish to measure the strain at more points (and thus a greater number of strain sensors can be employed). For example, if one uses the minimum feature size of keypad buttons as an example of a high-topography feature, they will express surface changes on the scale of a millimeter or less, which requires a minimum of at least one sensor for every fourth pixel (for 250 μm pixels).

EXAMPLES

Example 1

Use of a Deformable Display

A deformable display device that includes a deformable display including 1024×1024 pixels, a processor in communication with the deformable display, and a strain sensor array of 102×102 incorporated into the deformable display is provided. The strain sensor is in communication with the processor, and the processor is in communication with the deformable display. The deformable display is provided in a resting state, and an image is provided via the deformable display pixels. The deformable display device is then stretched an additional 20% in length and an additional 10% in width. The array of sensors detects the increases and adjusts the image accordingly, so that it more closely resembles the appearance of the image as it was on the resting state of the device, by keeping the ratio of the image consistent, even if the stretching changes the ratio of the dimensions of the display.

Example 2

Processing an Image to Appear Normal Under Deformation of a Display Surface

A deformable display device that includes a deformable display including 2560×2048 pixels, a processor in communication with the deformable display, and a strain sensor array of 256×205 incorporated into the deformable display is provided. The strain sensor is in communication with the processor, and the processor is in communication with the deformable display.

The deformable display is locked into a "distorted" arrangement, as it is integrated onto a trapezoidal surface. A rectangular original image is provided. The strain sensors are used to measure the amount of distortion of the display resulting from distorting the display to create a distortion map, which is used to adjust the original image to create a compensated image. The compensated image is then displayed on the distorted deformable display. The compensated image will have an appearance that is similar to the original image when displayed on the distorted deformable display.

Example 3

Processing an Image to Appear Normal Under Deformation of a Display Surface

A deformable display device that includes a deformable display including a first axis of 640 pixels and a second axis of 480 pixels, a processor in communication with the deformable display, and a strain sensor array of 64 (along the first axis) and 48 (along the second axis) incorporated into the deformable display is provided. The strain sensor is in communication with the processor, and the processor is in communication with the deformable display. The center of the display is known, as is the global scale factor of the first axis and the second axis.

One stretches the display device, thereby distorting the array of pixels and strain sensors. One then determines the displacement of 10% of the pixels from their original resting position to their stretched position. One then calibrates the pixel intensity to compensate for the displacement. The calibration of the pixel intensity involves determining a relative pixel intensity using Equation VIII:

$$I_{ki,kj}=I_0S_x(kj,ki)S_y(kj,ki) \qquad \text{Equation VIII}$$

wherein $I_{ki,kj}$ is the relative pixel intensity.

Example 4

Use of a Deformable Display

A deformable display device that includes a deformable display including 1024×1024 pixels, a processor in communication with the deformable display, and a strain sensor array of 102×102 incorporated into the deformable display is provided. The strain sensor array is made of leads of polydimethylsiloxane doped with multi-wall carbon nanotubes. The display itself is based on an elastomer substrate. The strain sensor is in communication with the processor, and the processor is in communication with the deformable display.

The deformable display device is stretched at least 20% in length and an additional 10% in width. The array of sensors detects the increases by an increase in resistance along the leads of polydimethylsiloxane and calculates a degree of stretching in given the physical displacement. An image to be displayed on the device is then adjusted so that a different subset of the pixels on the display are used, such that an image displayed occupies the same initial viewing area that it would have occupied, had it been displayed on an unstretched screen, by using those pixels that now occupy that initial viewing area, and not using those pixels that are outside of the initial viewing area.

Example 5

Manufacturing a Deformable Display

One can manufacture a deformable display by printing a strain sensor layer that includes an array of carbon nanotube strain sensors. This printed array is separate from the display layer. The display layer has a backplane that includes a stretchable polymer and conductive ink. The strain sensor layer is then laminated onto the display layer. This strain sensor layer is then connected to a central controller, which is configured to read information from the strain sensor layer and use it to calculate positional information.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, compositions or biological systems, which can, of course, vary. It is also to be understood that the terminology used herein is for the purpose of describing particular embodiments only, and is not intended to be limiting.

In an illustrative embodiment, any of the operations, processes, etc. described herein can be implemented as computer-readable instructions stored on a computer-readable medium. The computer-readable instructions can be executed by a processor of a mobile unit, a network element, and/or any other computing device.

There is little distinction left between hardware and software implementations of aspects of systems; the use of hardware or software is generally (but not always, in that in certain contexts the choice between hardware and software can become significant) a design choice representing cost vs. efficiency tradeoffs. There are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation; or, yet again alternatively, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via. Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and/or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a CD, a DVD, a digital tape, a computer memory, etc.; and a transmission type medium such as a digital and/or an analog communication medium a fiber optic cable, a waveguide, a wired communications link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

The herein described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

We claim:

1. A self-correcting deformable display, comprising:

a deformable display comprising at least a first pixel and a second pixel; and an array of strain sensors incorporated into the deformable display, wherein the array of strain sensors is configured to detect a distortion between the at least first pixel and the second pixel and to provide a datum regarding the distortion, wherein the deformable display is configured to compensate for a displacement of the at least first pixel or the second pixel by calibration of a pixel intensity of the at least first pixel or the second pixel, based on the displacement, and configured to display an adjusted pixel intensity of the at least first pixel or the second pixel in a compensated display image, wherein the array of strain sensors is configured to be in communication with a processor that generates a distortion map from a collection of strain values from the array of strain sensors, wherein a density of strain sensors in the array of strain sensors is about 1/10 a density of pixels in the deformable display and wherein the distortion map represents a distortion of an original image given a distortion to the deformable display, and wherein the distortion map is usable to adjust an appearance of the compensated display image in response to distortion of the deformable display.

2. The self-correcting deformable display of claim 1, wherein the array of strain sensors is configured to provide the datum to the processor to enable the processor to use the datum regarding the distortion to alter the compensated display image.

3. The self-correcting deformable display of claim 2, wherein the array of strain sensors comprises at least one of a resistive wire, a capacitive gauge, or a light guide.

4. The self-correcting deformable display of claim 3, wherein the resistive wire comprises at least one of: a carbon nano-tube, a conducting polymer, a graphite-filled polymer, a graphene-filled polymer, or a metal-filled polymer.

5. The self-correcting deformable display of claim 2, wherein the deformable display comprises an elastomer substrate.

6. The self-correcting deformable display of claim 1, wherein at least the first pixel and the second pixel are part of an array of pixels.

7. The self-correcting deformable display of claim 2, wherein the deformable display is configured to display an initial image provided by the processor, provide information from the array of strain sensors to the processor to enable the processor to transform the initial image into the compensated display image, and display the compensated display image.

8. The self-correcting deformable display of claim 2, wherein the array of strain sensors comprises polydimethylsiloxane doped with multi-wall carbon nanotubes.

9. The self-correcting deformable display of claim 8, wherein the array of strain sensors comprises a dual-axis resistivity strain gauge.

10. The self-correcting deformable display of claim 9, wherein the dual-axis resistivity strain gauge comprises a first member that intersects a second member.

11. The self-correcting deformable display of claim 10, wherein the first member that intersects the second member form a cross shape comprising a first end, a second end, a third end, and a fourth end.

12. The self-correcting deformable display of claim 11, wherein a first electrical lead is coupled to the first end, a second electrical lead is coupled to the second end, a third electrical lead is coupled to the third end, and a fourth electrical lead is coupled to the fourth end.

13. The self-correcting deformable display of claim 12, wherein the first electrical lead and the first end form about a 90 degree angle, wherein the second electrical lead and the second end form about a 90 degree angle, wherein the third electrical lead and the third end form about a 90 degree angle, and wherein the fourth electrical lead and the fourth end form about a 90 degree angle.

14. The self-correcting deformable display of claim 2, wherein the first pixel comprises a first light emitting diode and wherein the second pixel comprises a second light emitting diode.

15. A self-correcting deformable display, comprising:

a deformable display comprising at least a first pixel and a second pixel; and an array of strain sensors incorporated into the deformable display, wherein the array of strain sensors is configured to be in communication with a processor that generates a distortion map from a collection of strain values from the array of strain sensors, and wherein the distortion map represents a distortion of an original image given a distortion to the deformable display, wherein the distortion map is usable to adjust an appearance of a compensated image in response to distortion of the deformable display, and wherein a distance between a first strain sensor and a second strain sensor is no more than about $W_{max}$, wherein $W_{max}$=((distance between the at least first pixel and the second pixel)*π)/2*(maximum strain).

16. A self-correcting deformable display, the display comprising:

a display substrate comprising at least a first pixel and a second pixel;

an array of strain sensors associated with the display substrate, wherein the array of strain sensors is configured to detect a distortion between the at least first pixel and the second pixel and to provide a datum regarding the distortion, wherein a distance between a first strain sensor and a second strain sensor is no more than about $W_{max}$ wherein $W_{max}$=((distance between the at least first pixel and the second pixel)*π)/2*(maximum strain);

a processor configured to generate a distortion map from the array of strain sensors, wherein the distortion map comprises a collection of strain values from the array of strain sensors, and wherein the distortion map represents the distortion of an original image given a distortion to the display substrate; and a distortion compensation filter, the filter configured to use the distortion map to adjust the original image to a compensated image that can be displayed on the display substrate, wherein the distortion compensation filter is configured to compensate for the distortion of the original image to produce an appearance of the compensated image in response to the distortion to the display substrate.

17. The display of claim 16, wherein the appearance of the compensated image and the original image is of a same image.

18. The display of claim 16, wherein the appearance of the original image and the appearance of the compensated image is substantially similar.

19. A method to provide a self-correcting image, the method comprising:

distorting a deformable display to provide a distorted deformable display;

measuring at least one amount of distortion of the deformable display that results from distorting the display to create a distortion map, wherein said measuring at least one amount of distortion of the deformable display is measured by an array of strain sensors incorporated into the deformable display, wherein a density of strain sensors in the array of strain sensors is about 1/10 a density of pixels in the deformable display;

using the distortion map to adjust an original image to create a compensated image; and displaying the compensated image on the distorted deformable display, wherein one or more pixels in the compensated image has an adjusted pixel intensity relative to one or more corresponding pixels the original image, wherein displaying the compensated image comprises cropping such that only a subpart of the original image is viewable on the distorted deformable display, and wherein the compensated image has an appearance that is similar to the original image when the compensated image is displayed on the distorted deformable display.

20. The method of claim 19, wherein the measuring is achieved by measuring a change in a resistivity.

21. The method of claim 19, wherein the amount of distortion of the display is determined by measuring a displacement of at least one pixel from a first position to a second position, wherein in the first position, a surface of the deformable display, is at rest, and wherein in the second position, the surface of the deformable display is distorted.

22. The method of claim 19, wherein displaying the compensated image comprises dropping pixels in the cropped image from the deformable display so that the pixels do not participate in image creation.

23. A viewing surface comprising the display of claim 1, wherein the viewing surface is part of at least one of: a contact lens, a rigid curved surface, a flexible surface, or a display panel on an automobile.

* * * * *